United States Patent [19]

Barari

[11] Patent Number: 4,562,673

[45] Date of Patent: Jan. 7, 1986

[54] EARTHQUAKE SAFETY SUPPORT FOR TRANSPORTABLE BUILDINGS

[76] Inventor: Fred S. Barari, 1941 Hamilton Ave., San Jose, Calif. 95125

[21] Appl. No.: 566,956

[22] Filed: Dec. 28, 1983

Related U.S. Application Data

[63] Continuation of Ser. No. 259,867, May 4, 1981, abandoned.

[51] Int. Cl.[4] ..... E04D 15/00

[52] U.S. Cl. ..... 52/167; 52/126.1; 52/DIG. 11; 280/763.1

[58] Field of Search ..... 52/126.1, 126.6, DIG. 11, 52/197, 299, 263, 292, 126.7, 648, 73, 655; 280/763.1, 764.1, 762; 403/174, 172, 406; 248/352

[56] References Cited

U.S. PATENT DOCUMENTS

| | | | |
|---|---|---|---|
| 2,280,220 | 4/1942 | Crosby | 52/126.2 |
| 2,979,304 | 4/1961 | Teel . | |
| 3,195,694 | 7/1965 | De Castro | 52/DIG. 11 |
| 3,407,548 | 10/1968 | Russell | 52/126.1 |
| 3,537,724 | 11/1970 | Matthews | 280/763.1 |
| 3,747,951 | 7/1973 | Brown | 248/352 |
| 3,750,349 | 8/1973 | Deike | 52/23 |
| 3,823,958 | 7/1974 | Trejbal | 280/763.1 |
| 3,830,024 | 8/1974 | Warnke | 52/23 |
| 4,014,517 | 3/1977 | Keagle | 254/45 |
| 4,148,162 | 4/1979 | Goodrich | 52/DIG. 11 X |
| 4,214,410 | 7/1980 | Mitsueda | 52/143 |
| 4,261,149 | 4/1981 | Gustafson | 52/292 |
| 4,373,307 | 2/1983 | Evans | 52/167 |
| 4,417,426 | 11/1983 | Meng | 52/167 |

*Primary Examiner*—John E. Murtagh
*Attorney, Agent, or Firm*—Allston L. Jones

[57] ABSTRACT

A stabilizing support for mobile homes and other transportable buildings is disclosed which protects against damage caused by the building slipping off its piers in an earthquake. A base on the ground underneath the building is connected to the building frame by support arms and a stabilizer arm. In one embodiment, the support arms are connected in the form of an X. In another embodiment, two structures are connected via the stabilizer arms. Several embodiments may be constructed from the same basic components, and adjustment can be made for the varying height of buildings.

3 Claims, 5 Drawing Figures

EARTHQUAKE SAFETY SUPPORT FOR TRANSPORTABLE BUILDINGS

This is a continuation of application Ser. No. 259,867, filed May 4, 1981, now abandoned.

BACKGROUND OF THE INVENTION

Transportable buildings such as mobile homes are typically built upon a frame containing two or more longitudinal members and several transverse beams. This frame serves as both a support for the flooring of the building, and as a mounting base for wheel axles and towing couplers while the building is being transported. Although the frame may be designed with considerable strength to endure the loads on the structure encountered while the building is in transit, the frame design usually lacks any provision for stable, secure placement of the building when a destination is reached.

Most commonly, a mobile hole is positioned on a site be towing the home into place, jacking it up off its wheels, and placing a number of piers under the frame. When the jacks are removed, the piers bear the weight of the mobile home, which sits elevated above the ground. Mobile home piers are generally pyramidal or conical in shape, and may be made of bricks, steel, or concrete. While the piers may have provisions for leveling the mobile home and equally distributing the weight among the set of piers, there is basically no secure attachment of the mobile home frame to the piers. Hence, only the weight of the mobile home, pressing down through the frame onto the piers, keeps the mobile home in place.

Under ordinary circumstances, a mobile home may rest on its piers with apparent security, because no lateral forces are present to displace the structure. However, significant lateral forces may arise from natural events such as severe windstorms, or more importantly, earthquakes. The lateral forces developed in an earthquake may cause the mobile home to shift off the piers and crash to the ground, injuring persons and property. The piers themselves may cause significant damage by piercing through the flooring of the building when the frame shifts laterally.

SUMMARY OF THE INVENTION

In accordance with the preferred embodiments of the present invention, a stabilizing support for transportable buildings protects against damage caused by a transportable building slipping off the normally unattached pier supports. In one preferred embodiment, a pair of diagonal support arms connect the frame of a transportable building to a base on the ground, while a stabilizing arm connects the support structure to a third point on the frame. Two such support structures may be connected together by crossing their stabilizing arms and connecting them. In another embodiment, the support arms are connected in an X-shape. High strength is achieved by using lengths of angle steel for the arms, while variations in height of buildings can be accommodated by adjusting the angle of the support arms. Several embodiments may be constructed using the same basic components, offering adaptability and simplicity in manufacturing.

DESCRIPTION OF THE PREFERRED EMBODIMENTS

Figure 1:
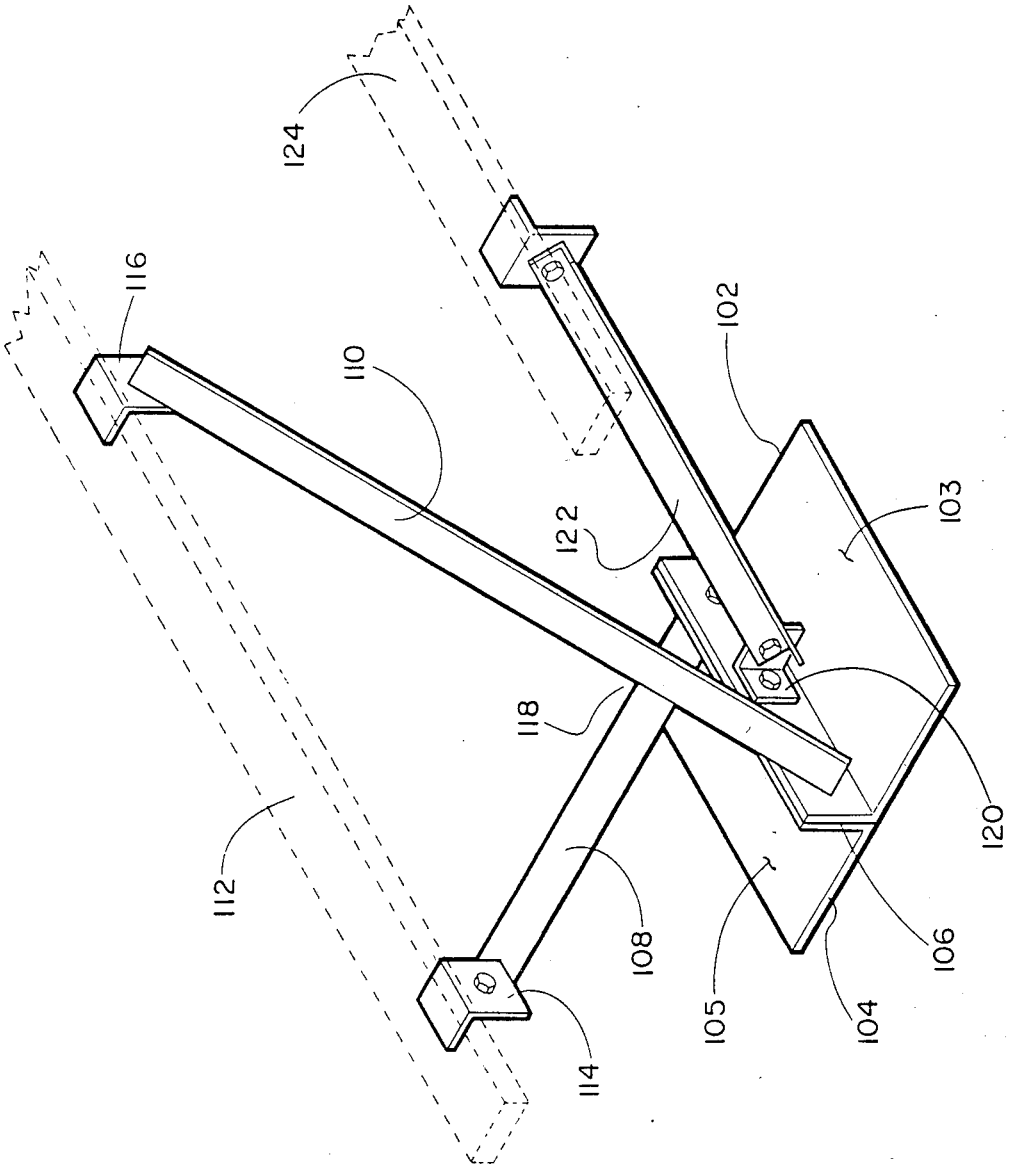
FIG. 1 shows a stabilizing support having support arms generally in an X-shaped configuration.

Referring now to FIG. 1, a base 102 is positioned on the ground underneath a transportable building. For exemplary purposes, the transportable building may be taken to be a mobile home, although similar structures used for other purposes will also benefit from the present invention. In the preferred embodiment, base 102 is easily formed by bolting together two flanged metal plates 103 and 105 to produce a horizontal surface 104 and a common vertical flange 106.

A pair of support arms 108 and 110, preferably of $2'' \times 3'' \times \frac{1}{4}''$ angle steel, connect base 102 to a first mobile home frame member 112. Brackets 114 and 116 provide surfaces for bolting support arms 108 and 110 to frame member 112. The lower ends of support arms 108 and 110 are connected to base 102 in the preferred embodiment by bolting them to opposite sides of flange 106.

Support arms 108 and 110 are positioned to cross each other above base 102 in this embodiment. The angle at which the support arms are placed may be adjusted to compensate for variations in the height of mobile homes above ground, although an angle of 45° to the horizontal is preferred. Once the support arms have been installed on the base and the mobile home frame, and the angle is fixed, a hole may be drilled through support arms 108 and 110 at crossing 118, and the arms may be bolted at 118 into a shape resembling the letter "X". Support arms 108 and 110 are preferably of a single-piece construction and of equal length to produce a symmetrical X-shape, and lie in a vertical plane.

A bracket 120, bolted to flange 106, connects a stabilizer arm 122 to base 102. Stabilizer arm 122 may be constructed of the same material as support arms 108 and 110, but must be of proper length to reach a second mobile home frame member 124, which is parallel to frame member 112. If frame members are not conveniently located, additional members may be added to the frame to provide suitable attaching points. Stabilizer arm 122 lies in a plane orthogonal to the plane of the ground and to the vertical plane of the support arms.

Figure 2:
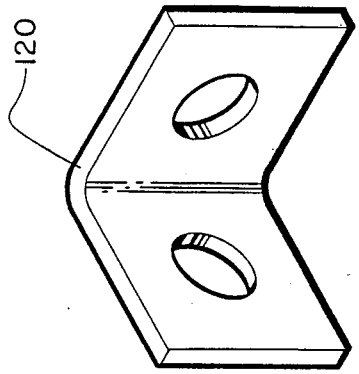
FIG. 2 shows the bracket for attaching the stabilizer arm to the base.

FIG. 2 shows more clearly the configuration of bracket 120 of FIG. 1 which interconnects stabilizer arm 122 and flange 106.

Figure 3:
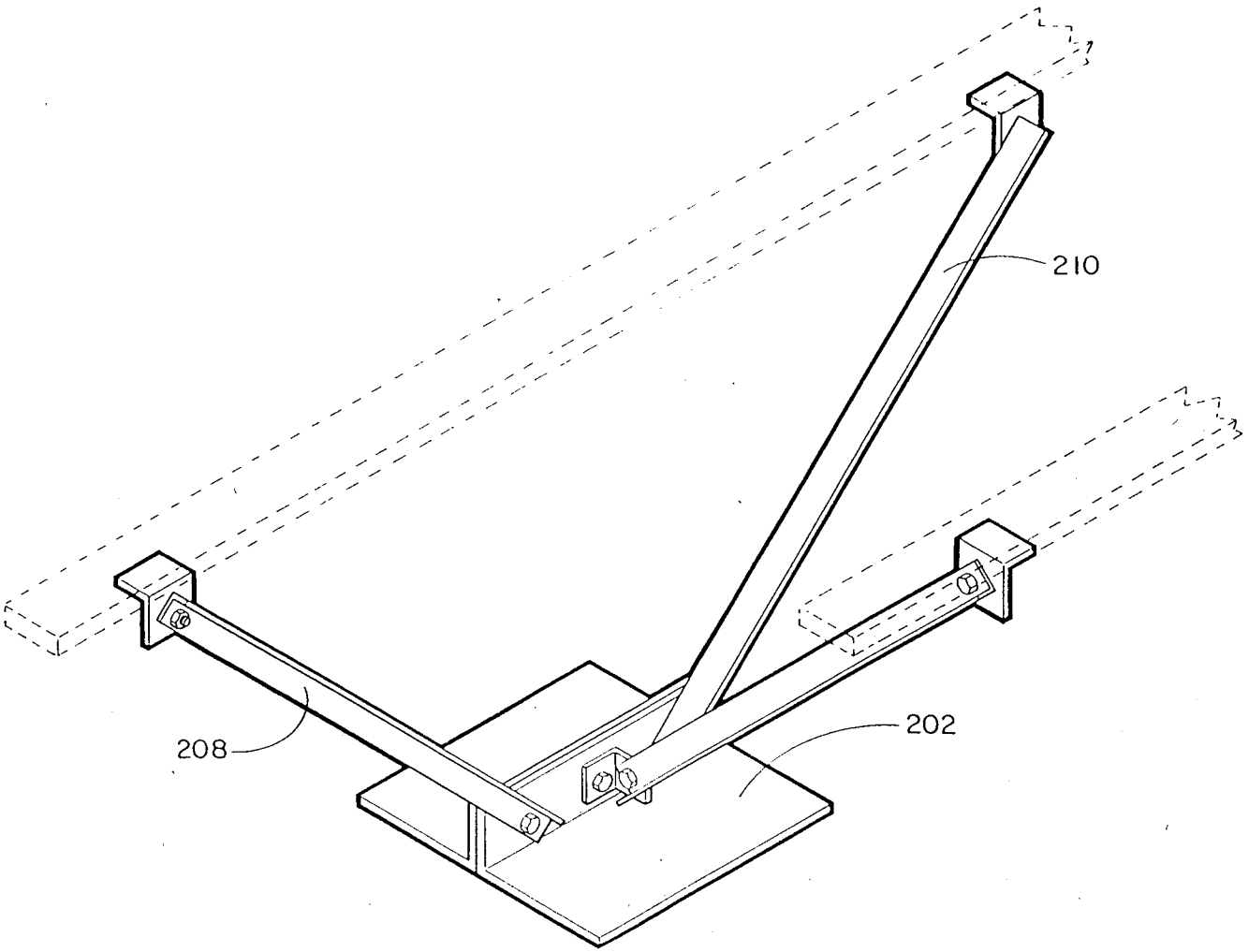
FIG. 3 shows a stabilizing support having uncrossed support arms.

Referring now to FIG. 3, another embodiment employs a pair of support arms 208 and 210 which spread outward from base 202 without crossing. The embodiment of FIG. 2 may be constructed using the same components as the embodiment of FIG. 1 by changing the placement of the support arms. Equal length support arms and 45° placement with respect to the horizontal are preferred for this embodiment.

Figure 4:
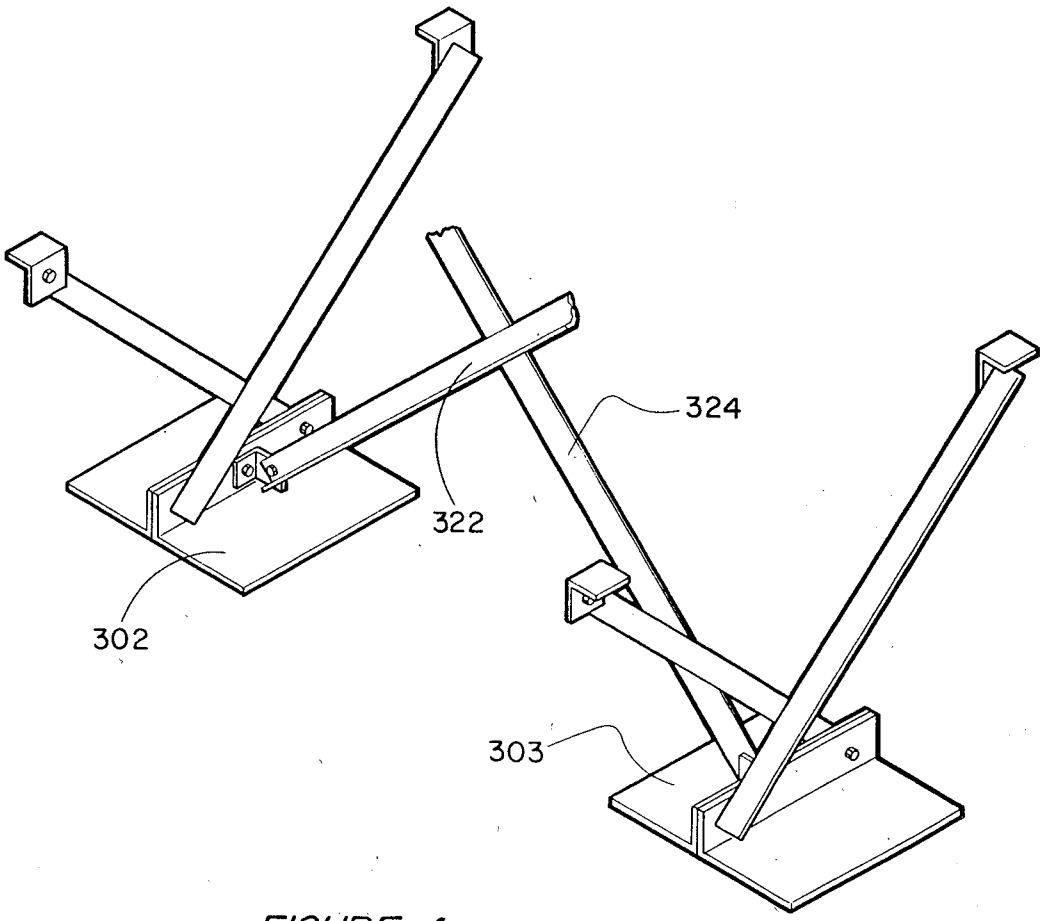
FIG. 4 shows a stabilizing support having two structures with connected stabilizing arms.

Referring now to FIG. 4, another embodiment uses two of the basic structures of FIG. 1. Stabilizing arms 322 and 324 are crossed and connected in a fashion analogous to the positioning of the support arms, thus linking base 302 to base 303.

Figure 5:
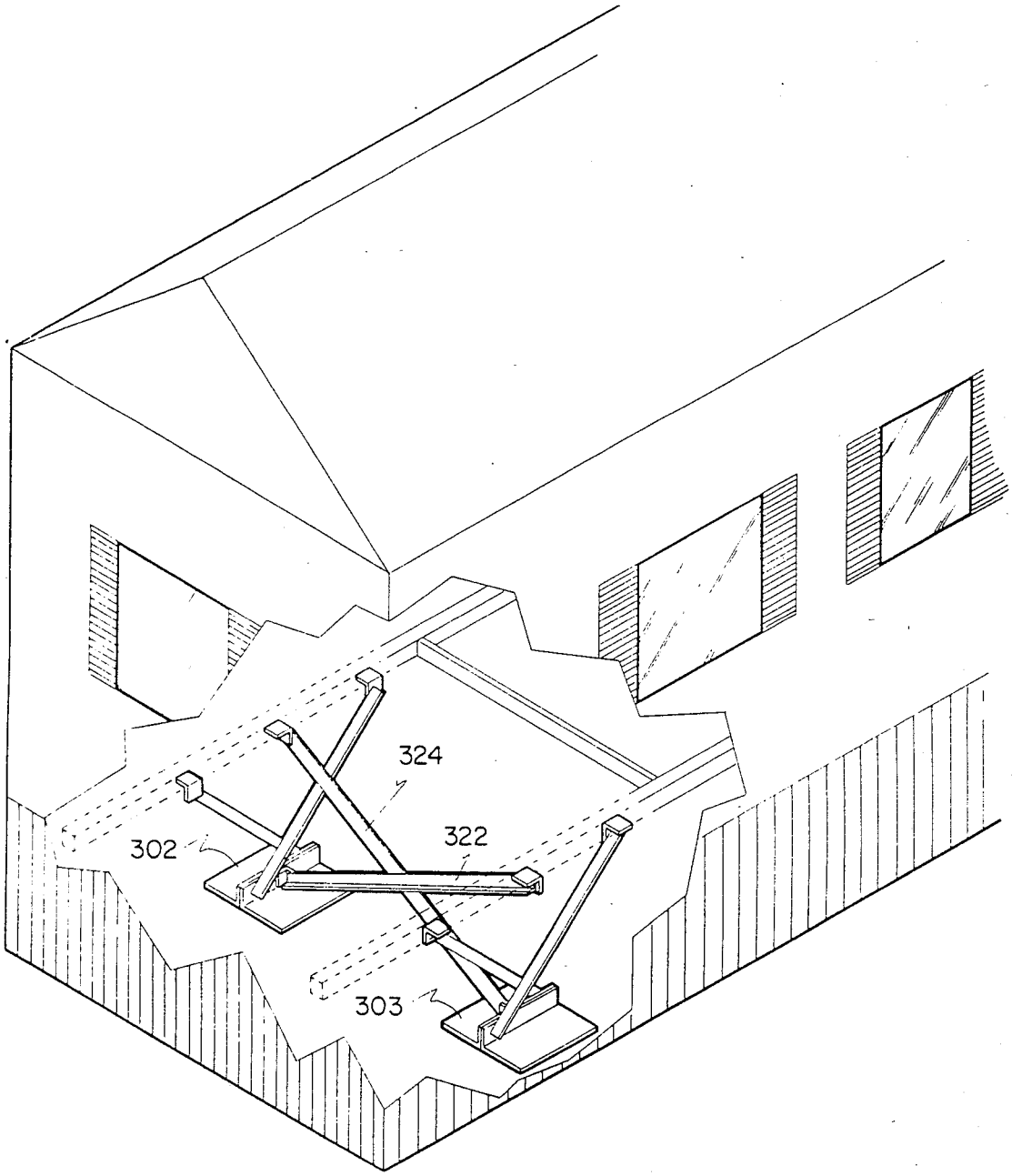
FIG. 5 shows a cut-away view of a mobile home with the dual stabilizing support of FIG. 4 in place.

In FIG. 5, the configuration of FIG. 4 is shown, in a cut-away view, in place under a mobile home. This dual-stabilizer application could just as well be accomplished with a pair of the units shown in FIG. 3.

High strength is achieved by each configuration in the preferred embodiments. The load capacity of a compression member such as a support arm in the present invention is well-known to vary with the ratio Kl/r, where K is a constant (equal to 1 for the preferred angle of 45°), l is the length of the arm, and r is the radius of gyration, which depends on sectional properties of the arms. For example, for a 24" arm of the preferred 2"×3"×¼" steel, r=0.391 and Kl/r=61.38. The correspondingly allowable load per area is 17.3 Ksi, which yields 16.2 Kps for the preferred arm configuration. A more complete discussion of this mode of analysis may be found in the text *Structural Steel Design* by Joseph Bowles (New York McGraw-Hill, 1980), chapter 6.

The preferred embodiments, which are installed after the mobile home is mounted on piers in the usual way. Thus, they provide a strong stabilizing support for transportable buildings to protect them and their contents against damage which may be caused by them slipping off the piers. Adjustment can easily be made for variations in the height of buildings, and several embodiments may be constructed from the same basic components. Additionally, these embodiments minimize the number of pieces necessary to construct each support and require that only about six different lengths of arms be stocked for all possible installations.

I claim:

1. A stabilizing support for a transportable building, the underside of the building having a plurality of parallel beams arranged to be supported above the ground, said support consisting of:

a base disposed for resting on the ground, said base having a single planar vertically extending flange;

a pair of rigid support arms of substantially equal length, each of the support arms extending diagonally upward from the base for attachment to a first of said plurality of parallel beams, each of the support arms having a lower end affixed to the vertically extending flange of the base and an upper end disposed to be connected to said first of said beams with both support arms in a vertical plane generally in an x-shaped configuration; and a single rigid stabilizing arm extending diagonally upward from the base to a second of said plurality of parallel beams, having one end affixed to the vertically extending flange of the base and the other end disposed to be connected to said second of said beams.

2. A stabilizing support for a transportable building as in claim 1 wherein the support arms and the stabilizing arm are lengths of angle steel.

3. A stabilizing support for a transportable building as in claim 1 wherein said stabilizing arm lies in a plane orthogonal to the ground and to the plane of the support arms.

* * * * *